US006655543B2

(12) United States Patent
Beuke

(10) Patent No.: US 6,655,543 B2
(45) Date of Patent: Dec. 2, 2003

(54) HIGHLY ADAPTABLE THERMAL INSULATOR FOR ADAPTING TO AN UNPRECEDENTED RANGE OF SIZES AND SHAPES OF BEVERAGE CONTAINERS

(76) Inventor: Doyle Keith Beuke, P.O. Box 40607, Austin, TX (US) 78704

( * ) Notice: Subject to any disclaimer, the term of this patent is extended or adjusted under 35 U.S.C. 154(b) by 51 days.

(21) Appl. No.: 10/046,901

(22) Filed: Jan. 15, 2002

(65) Prior Publication Data

US 2002/0104845 A1 Aug. 8, 2002

Related U.S. Application Data

(60) Provisional application No. 60/262,456, filed on Jan. 18, 2001.

(51) Int. Cl.[7] ..... B65D 25/00
(52) U.S. Cl. ..... 220/739; 220/903; 229/403
(58) Field of Search ..... 220/739, 903; 229/403

(56) References Cited

U.S. PATENT DOCUMENTS

| | | | | | |
|---|---|---|---|---|---|
| 2,522,381 | A | * | 9/1950 | Kramer | 220/739 X |
| 4,248,366 | A | | 2/1981 | Christiansen | |
| 4,462,444 | A | * | 7/1984 | Larson | 220/903 X |
| 4,513,895 | A | | 4/1985 | Leslie | |
| 4,514,995 | A | * | 5/1985 | Curtis et al. | 66/170 |
| 4,577,474 | A | | 3/1986 | Peterson | |
| 4,619,553 | A | | 10/1986 | Fischer | |
| 4,802,602 | A | * | 2/1989 | Evans et al. | 220/739 |
| 5,065,879 | A | * | 11/1991 | King | 220/739 |
| 5,251,460 | A | * | 10/1993 | DeMarco et al. | 220/903 X |
| 5,320,249 | A | * | 6/1994 | Strech | 220/739 |
| 5,325,991 | A | * | 7/1994 | Williams | 220/739 |
| 5,381,922 | A | | 1/1995 | Gladman et al. | |
| 5,609,265 | A | * | 3/1997 | Haberkorn et al. | 220/739 X |
| 5,653,124 | A | | 8/1997 | Weber | |
| 5,775,530 | A | | 7/1998 | Attaway | |
| 5,845,806 | A | * | 12/1998 | Parchman | 220/739 |
| 6,019,245 | A | * | 2/2000 | Foster et al. | 220/739 |
| 6,164,487 | A | * | 12/2000 | Hicks | 220/739 |
| 6,182,855 | B1 | * | 2/2001 | Alpert | 220/739 |
| 6,286,754 | B1 | * | 9/2001 | Stier et al. | 229/403 |

FOREIGN PATENT DOCUMENTS

FR 2633-258 A3 12/1989

* cited by examiner

*Primary Examiner*—Joseph M. Moy
(74) *Attorney, Agent, or Firm*—Michael E. Noe, Jr.; Bracewell & Patterson, L.L.P.

(57) ABSTRACT

A highly adaptable beverage container insulator is designed for a significant size range of beverage containers. The insulator is tubular with open ends that are formed from two elastic panels. Each panel has straight top and bottom edges with elastic hems. The side edges of each panel are slightly curved to maintain the properties and proper appearance of the insulator. To form the insulator, two of the panels are joined along their side edges to form a tube. The insulator is placed around a beverage container to better insulate the container and maintain the temperature of the beverage located therein. The insulator accommodates significant variation in the size and shape of beverage containers. For example, a smaller version of the insulator is readily adaptable to conform to both a standard twelve ounce soda can and to a ten ounce juice bottle.

19 Claims, 8 Drawing Sheets

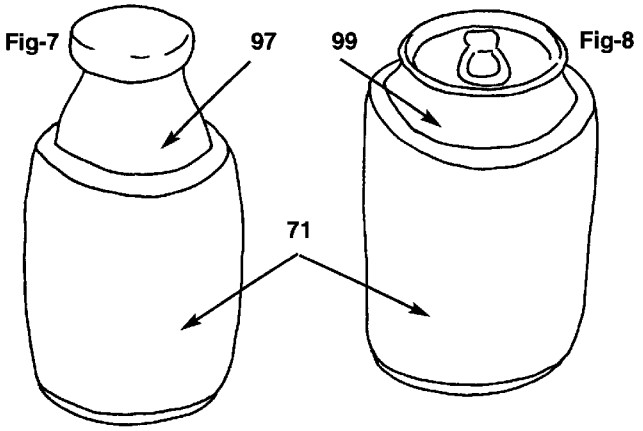
Fig-7
97
99
Fig-8
71
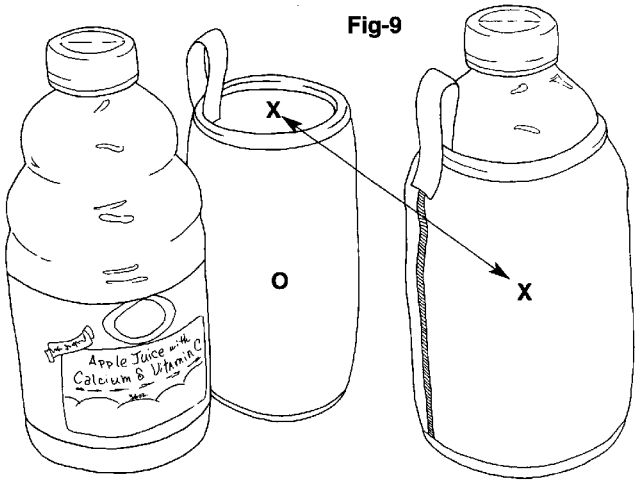
Fig-9
X
O
X
Apple Juice with
Calcium & Vitamin C
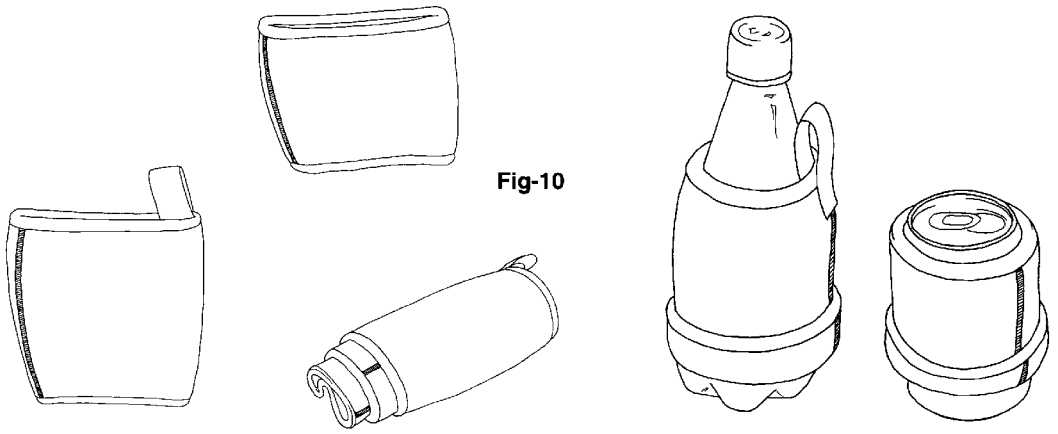
Fig-10

HIGHLY ADAPTABLE THERMAL INSULATOR FOR ADAPTING TO AN UNPRECEDENTED RANGE OF SIZES AND SHAPES OF BEVERAGE CONTAINERS

This patent application claims the benefit of the filing date of U.S. Provisional Patent Application No. 60/262,456, filed Jan. 18, 2001.

BACKGROUND OF THE INVENTION

1. Technical Field

The present invention relates in general to beverage insulators, and in particular to a highly conformable beverage container insulator that is capable of readily and accurately adapting to containers over an unprecedented range of container sizes.

2. Description of the Prior Art

Conventional beverage container insulators, commonly referred to as "koozies," are used to thermally insulate a hot or cold beverage and allow a user to comfortably grasp the container regardless of the temperature of the beverage and container. Such insulators are well known in the art. A few examples of conventional insulators are disclosed in U.S. Pat. Nos. 5,381,922, 5,653,124, and 4,577,474. Although each of these prior art provide good beverage insulation, they are specifically designed to fit beverage containers of a very limited size and shape and, thus, are not adaptable for different sized containers.

A few attempts have been made to overcome the adaptability limitations of these conventional insulators. For example, French Patent No. 2633-258-A, discloses an insulator that is very similar to the '922 patent, except that it is formed from a material that is "sufficiently elastic to allow it to adapt to containers of different sizes." Although this French design probably has a very limited range of adaptability, it consists "(1) of a thick thermal insulating material, and a base (2) of the same material." Such thick material may be flexible, but is unable to adapt to the shapes and sizes of a wide range of containers. Moreover, the base is sealed to the lower end of the body and greatly reduces the ability of the insulator to adapt at its lower end.

Another prior art insulator design is disclosed in U.S. Pat. No. 4,513,895. This insulator is a complicated mechanism comprising an outer shell of resilient polymer, a harness for wrapping around a beverage, and an exterior cloth jacket which is sewn to the harness. In addition, the jacket is provided with a separate closure panel and carrying straps. Furthermore, the closure panel is provided with a stiff fabric retaining shoulder, an apron, and a drawstring at its upper end. Although this design is workable, it is unnecessarily complicated.

U.S. Pat. No. 4,248,366 discloses a beverage container carrier formed with a sleeve-like casing and a flexible line formed in a loop extending through the casing. This design also has a number of features that significantly limit its adaptability to beverage containers of varying size. This prior art insulator may be saddle-shaped (FIGS. 1–2), or Coke® bottle shaped (FIGS. 3–4). The stiff ribbing along the upper convoluted edge of the first embodiment, and the very narrowly tapered neck of the second embodiment greatly limit the ability of insulator to adapt to the upper ends of non-conforming bottles. Moreover, each embodiment (and every other prior art insulator) has a closed lower end (FIG. 6) for supporting the bottom of a container, and is interlaced with a cord 12 extending through a large number of apertures in the body. Thus, a highly conformable beverage container insulator that is capable of readily and accurately adapting to containers over an unprecedented range of container sizes would be desirable.

SUMMARY OF THE INVENTION

One embodiment of a highly adaptable beverage container insulator is specifically designed for use with beverage containers having a fluid capacity of approximately one quart to 1.5 liters. Other embodiments of the insulator of the present invention are designed for smaller and larger size ranges of beverage containers. The insulator is tubular with open ends that are formed from two elastic panels. Each panel has straight top and bottom edges with elastic hems. The side edges of each panel are slightly curved to maintain the properties and proper appearance of the insulator. To form the insulator, two of the panels are joined along their side edges to form a tube.

The insulator is placed around a beverage container to better insulate the container and maintain the temperature of the beverage located therein. The insulator accommodates significant variation in the size and shape of beverage containers. For example, a smaller version of the insulator is readily adaptable to conform to both a standard twelve ounce soda can and to a ten ounce juice bottle. The panel construction of the insulator allows it to laid flat for easy stowage, and multiple insulators may be stored within a single insulator for better bulk management.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

FIG. 7 illustrates the beverage insulator of FIG. 5 mounted to a container having a short, wide profile.

FIG. 8 illustrates the beverage insulator of FIG. 5 mounted to a container having a tall, thin profile.

FIG. 9 illustrates a reverse surface of the beverage insulator of FIG. 5.

FIG. 10 is an isometric view of the beverage insulator of FIG. 5 in a stowed position.

DETAILED DESCRIPTION OF THE PREFERRED EMBODIMENT OF THE PRESENT INVENTION

Figure 1:
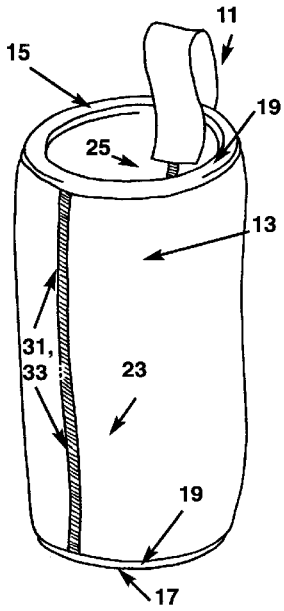
FIG. 1 is an isometric view of a first embodiment of a beverage insulator constructed in accordance with the present invention.

Referring to FIG. 1, a first embodiment of the present invention is shown as beverage container insulator 11. Insulator 11 is an improved beverage insulation wrap, which, in conventional terminology, is commonly referred to as a "koozie." This first embodiment is currently the largest of three sizes of the present invention, and is specifically designed for use with various sized beverage containers having a fluid capacity of approximately one quart to 1.5 liters. For example, comparing FIGS. 11–14, the same insulator 11 may be used interchangeably on quart-size (32 oz.) juice bottles, much larger 46 oz. juice jugs, and almost anything else in between including but not limited to bottle shapes such as square bottles, square bottles with round tops, tall round bottles with narrow, medium, or full necks, short round bottles, and tall narrow bottles. Thus, insulator 11 readily fits, conforms, and contours to each of these beverage containers.

Figure 2:
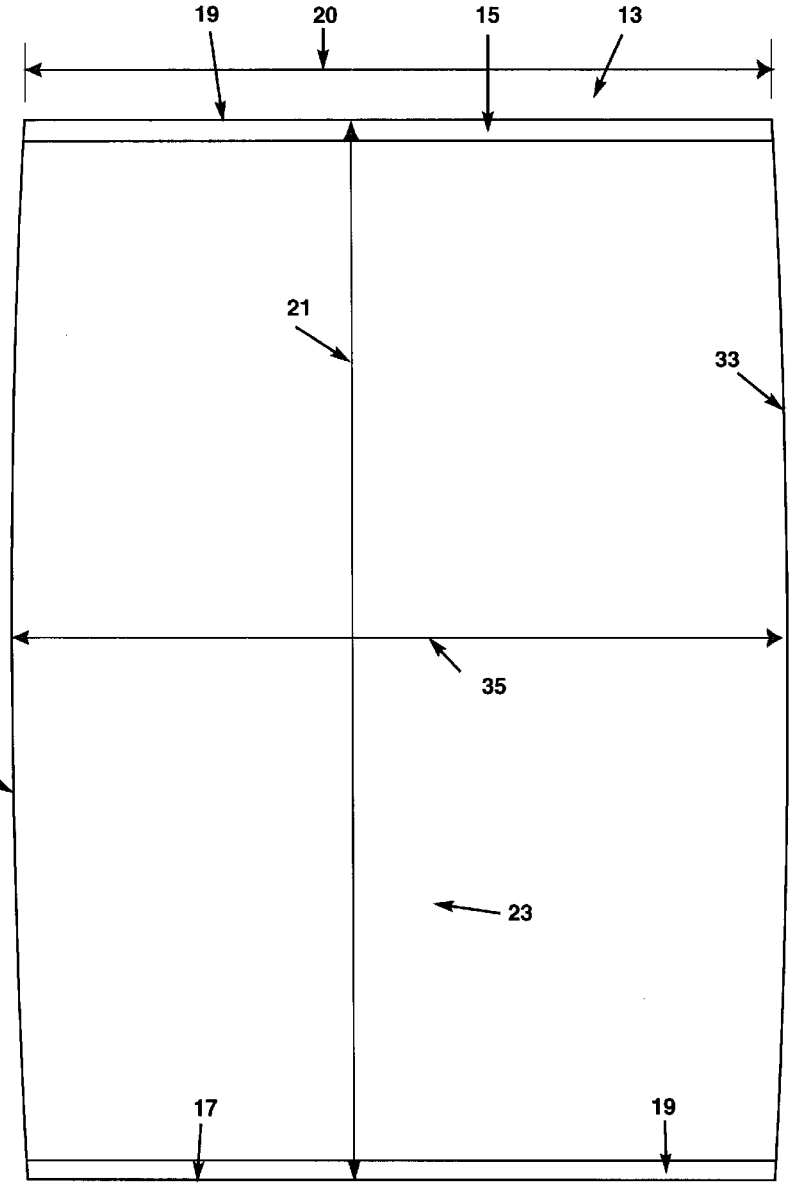
FIG. 2 is a plan view of one of the panels of the beverage insulator of FIG. 1 prior to assembly.

Insulator 11 has a generally tubular shape with open, circular, upper and lower ends. Ideally, insulator 11 has no apertures other than its two open ends and, thus, it has no bottom support for a container. Insulator 11 is formed from a plurality (preferably two) of the flat, generally rectangular panels 13 shown in FIG. 2. In the preferred embodiment, each panel 13 comprises an elastic neoprene material that is approximately 5 to 6.5 mm thick. As will be described in greater detail below, insulator 11 is reversible (see FIG. 9) since each surface 23, 25 (FIG. 1) of each panel 13 is covered with a colored or graphically illustrated elastic sheet that is bonded or otherwise permanently joined to the neoprene substrate of panel 13.

In the first embodiment of the present invention, each panel 13 has substantially straight, horizontal top and bottom edges 15, 17, respectively. Each edge 15, 17 measures approximately 12.75 cm in width 20 between their respective ends. During use of insulator 11, panels 13 will have an upright or "vertical orientation," wherein top and bottom edges 15, 17 are oriented "horizontally" at the top and bottom, respectively, of insulator 11. In this disclosure, the term "horizontal" refers to a direction that is substantially perpendicular to "vertical." Top and bottom edges 15, 17 are parallel and define a substantially consistent, overall vertical dimension or height 21 therebetween for panel 13 of approximately 16.75 cm.

Each edge 15, 17 is provided with a horizontal, circumscribing, elastic band or hem 19 that has a vertical dimension of approximately 9 mm. In the version shown, hems 19 are formed from an elastic material, but are preferably black in color regardless of the color or illustration emblazoned on the two opposite surfaces 23, 25 of panel 13. Ideally, hem 19 is extends contiguously around both panels 13 (after assembly) with, at most, a single seam that is concealed by the pull tab loop adjacent to and extending from top edge 15.

Each panel 13 also has a pair of side edges 31, 33 that extend between top and bottom edges 15, 17. In the version shown, side edges 31, 33 are slightly curved or arcuate (ideally, symmetrically convex) and, thus, are not quite parallel to each other. The curvature is due to the maximum width 35 of panel 13 in the horizontal direction being approximately 12.25 cm, as measured between the vertical midpoints of side edges 31, 33. Because the width of top and bottom edges 15, 17 is only 11.75 cm, the side edges 31, 33 of panel 13 must be skewed to make up the difference of 0.50 cm. The difference in these two horizontal dimensions is an important parameter for maintaining the properties and proper appearance of insulator 11.

To form insulator 11, two of the panels 13 are bonded and sewn together along their respective side edges 31, 33 to form a generally cylindrical shape (FIG. 1). Insulator 11 has two open ends: one defined by top edge 15, and one defined by bottom edge 17. The dimensions of panels 13 give insulator 11 a slightly smaller diameter its top and bottom edges 15, 17 than its cylindrical body in between. In addition, the extra material at hems 19 make top and bottom edges 15, 17 slightly less elastic than the remaining unencumbered neoprene of panels 13. This construction gives insulator 11 the unique ability to conform to both the vertical and horizontal dimensions of a wide range of sizes of beverage containers. Moreover, top and/or bottom edges 15, 17 may be rolled down and up, respectively (see right side of FIG. 10), to further customize the vertical dimension of insulator 11.

Figure 3:
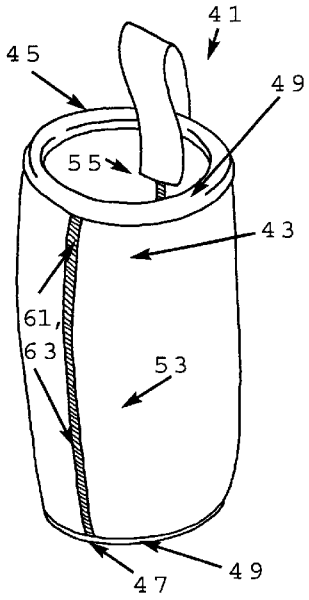
FIG. 3 is an isometric view of a second embodiment of a beverage insulator constructed in accordance with the present invention.
Figure 15:
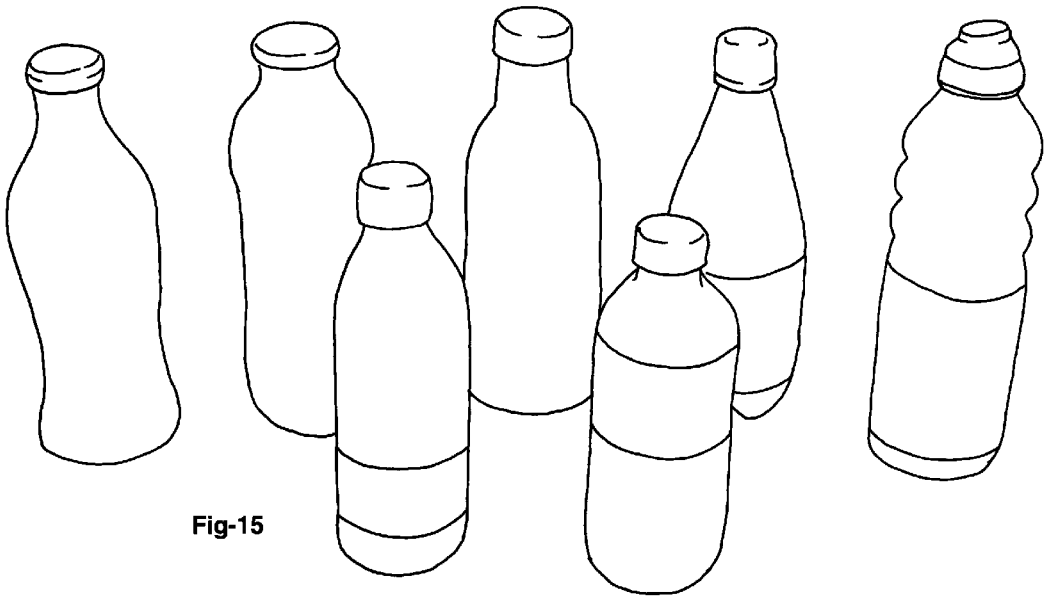
FIG. 15 is an isometric view of a variety of beverage containers suitable for use with the insulator of FIG. 3.
Figure 16:
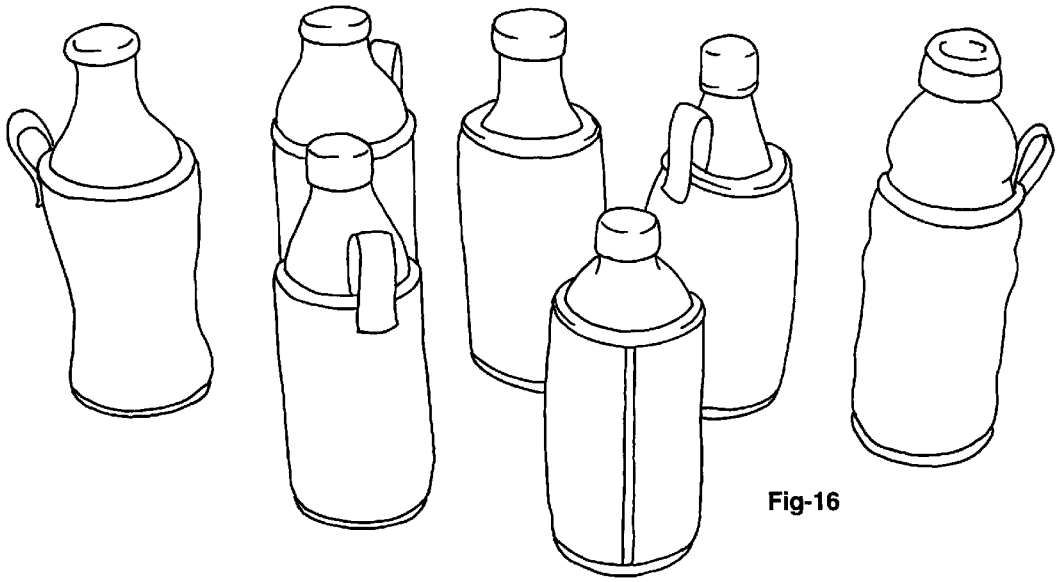
FIG. 16 is an isometric view of the beverage containers of FIG. 15 each of which is covered with an insulator of FIG. 3.

Referring now to FIG. 3, a second embodiment of the present invention is shown as beverage container insulator 41. Insulator 41 is virtually identical to insulator 11 in form and function, except that insulator 41 is slightly smaller in size and specifically designed for use with beverage containers having a fluid capacity of approximately 500 to 750 ml. For example, comparing FIGS. 15 and 16, the same insulator 41 may be used interchangeably on bottle shapes such as odd shape bottles, tall round bottles with full, medium, or narrow necks, short round bottles, and tall narrow bottles. Thus, insulator 41 readily fits and contours to each of these beverage containers.

Figure 4:
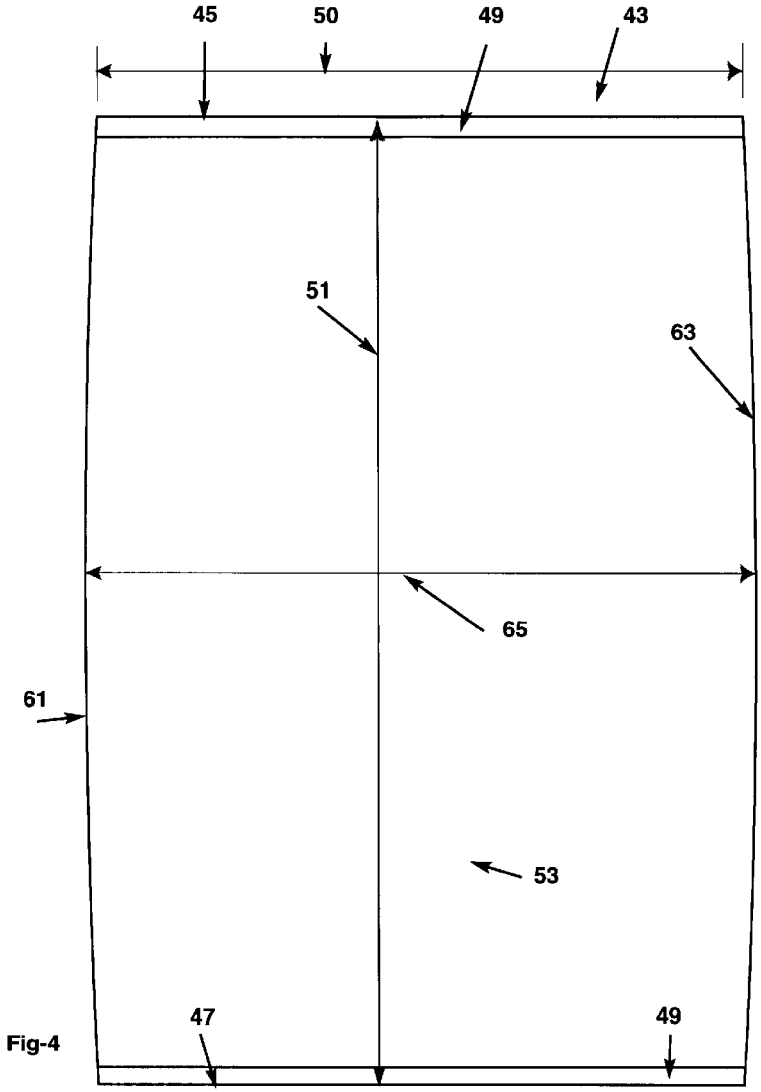
FIG. 4 is a plan view of one of the panels used to form the beverage insulator of FIG. 3 prior to assembly.

Insulator 41 is also ideally formed from two (or more) of the panels 43 (FIG. 4) of neoprene, each having two reversible surfaces 53, 55. Each panel 43 also has horizontal top and bottom edges 45, 47, respectively, measuring approximately 10 cm in width 50. Top and bottom edges 45, 47 have a vertical dimension 51 of approximately 15 cm. Each edge 15, 17 is provided with an elastic hem 49 having a vertical dimension of approximately 9 mm.

The curved side edges 61, 63 of panel 43 extend between top and bottom edges 45, 47. Side edges 61, 63 define a maximum width 65 in the horizontal direction of approximately 10.375 cm between their vertical midpoints. The narrow width of top and bottom edges 45, 47 skews side edges 61, 63 to make up the difference of 0.375 cm. Again, the difference in these two horizontal dimensions is an important parameter for maintaining the properties and proper appearance of insulator 41. Insulator 41 is formed by sewing two panels 43 together along their side edges 61, 63 (FIG. 3). The smaller diameters of top and bottom edges 45, 47, and the extra material at hems 49, give insulator 41 the unique ability to conform to both the vertical and horizontal dimensions of a beverage container.

Figure 5:
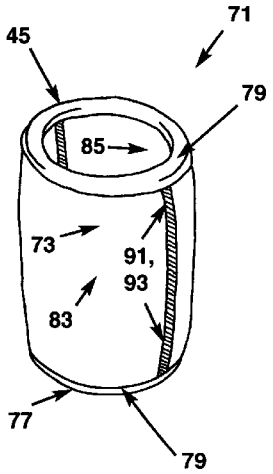
FIG. 5 is an isometric view of a third embodiment of a beverage insulator constructed in accordance with the present invention.
Figure 17:
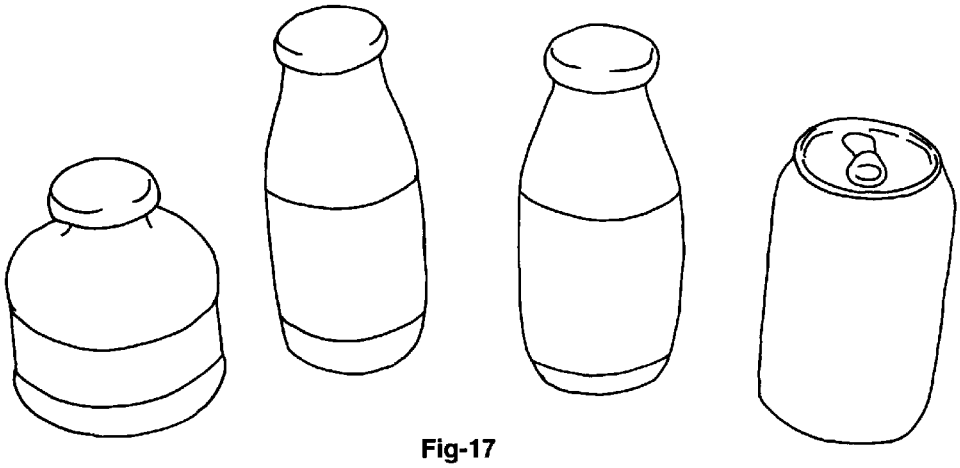
FIG. 17 is an isometric view of a variety of beverage containers suitable for use with the insulator of FIG. 5.
Figure 18:
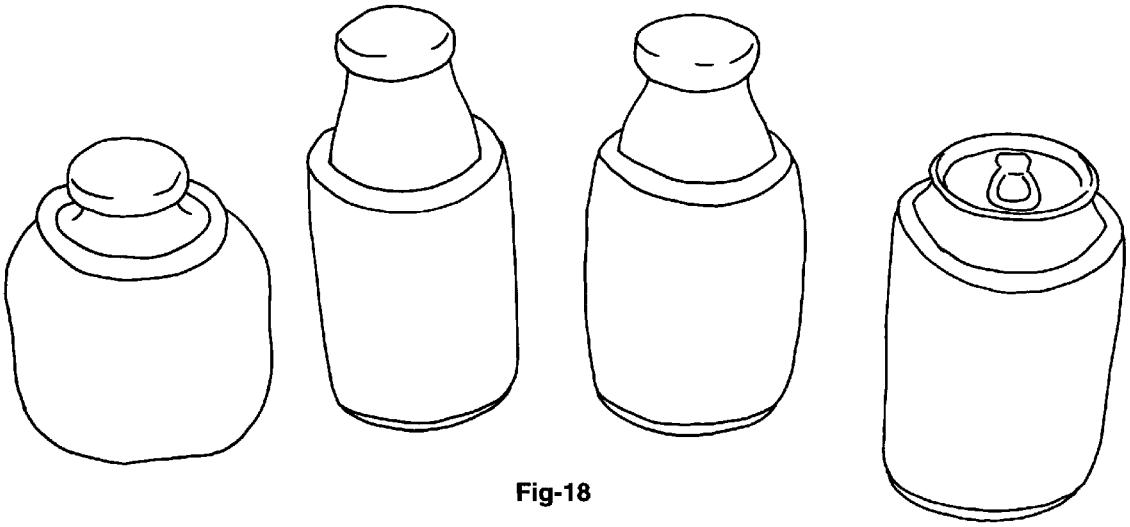
FIG. 18 is an isometric view of the beverage containers of FIG. 17 each of which is covered with an insulator of FIG. 5.

Referring now to FIG. 5, a third embodiment of the present invention is shown as beverage container insulator 71. Insulator 71 is the smallest embodiment and designed for use with a variety of smaller beverage containers having a fluid capacity of approximately 10 to 12 oz. For example, by comparing FIGS. 17 and 18, it is readily apparent that the same insulator 71 may be used interchangeably on bottle shapes such as such as common juice bottles, common carbonated beverage cans, and very round juice bottles. Thus, insulator 71 readily fits and conforms to each of these beverage containers.

Figure 6:
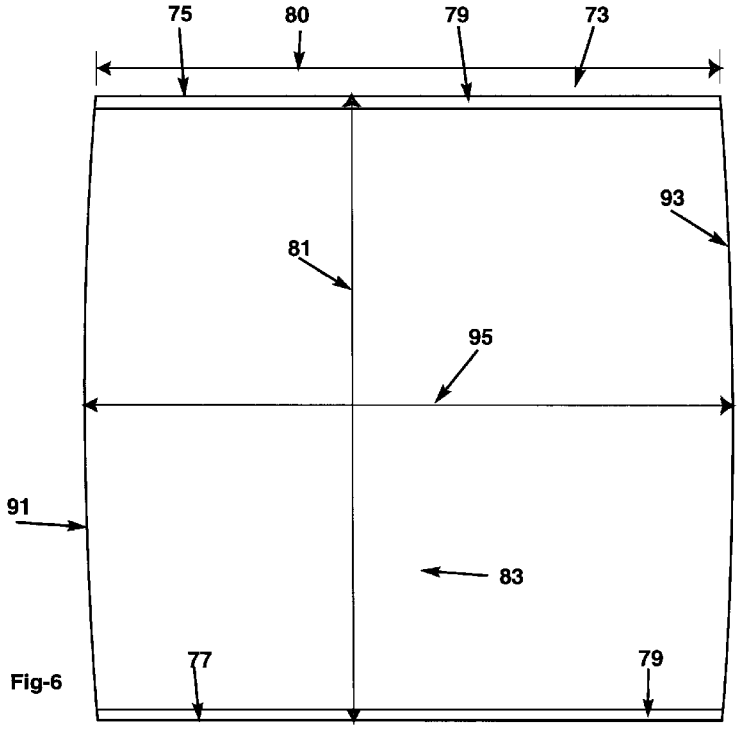
FIG. 6 is a plan view of one of the panels used to form the beverage insulator of FIG. 5 prior to assembly.
Figure 11:
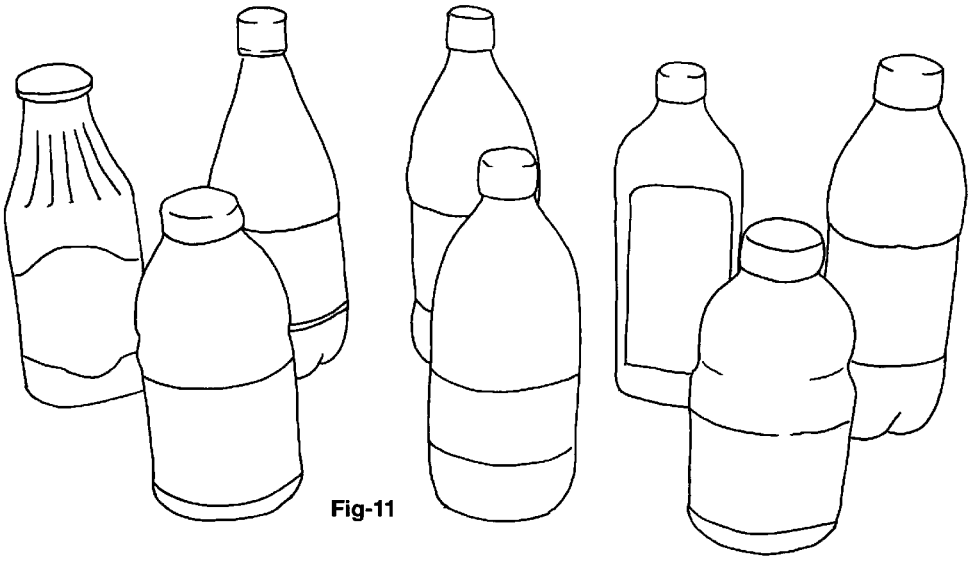
FIG. 11 is an isometric view of a variety of beverage containers suitable for use with the insulator of FIG. 1.
Figure 12:
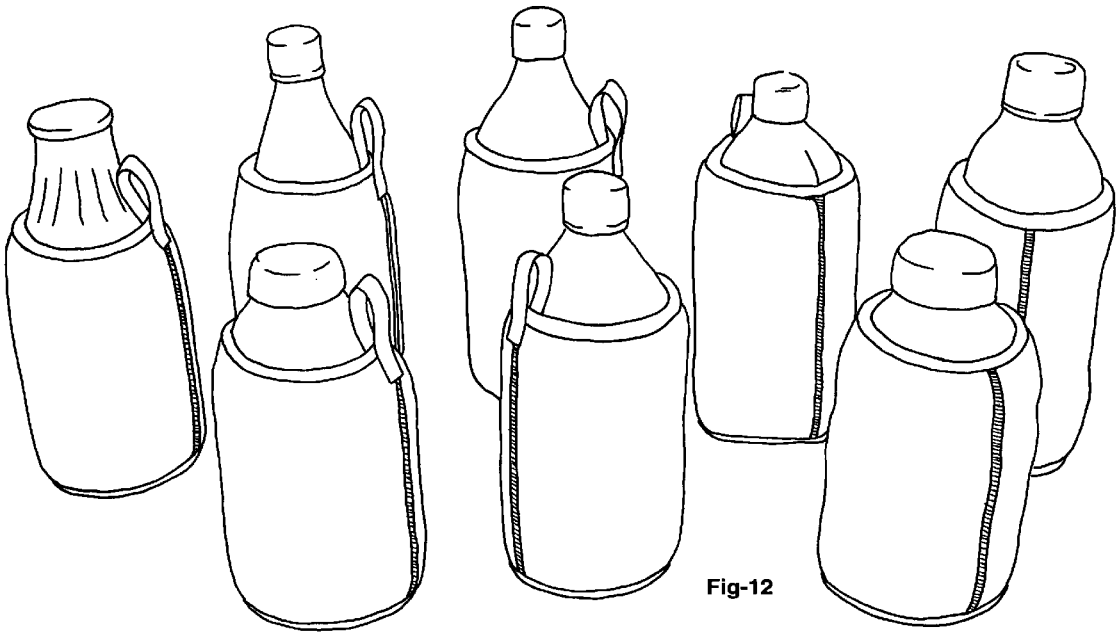
FIG. 12 is an isometric view of the beverage containers of FIG. 11 each of which is covered with an insulator of FIG. 1.
Figure 13:
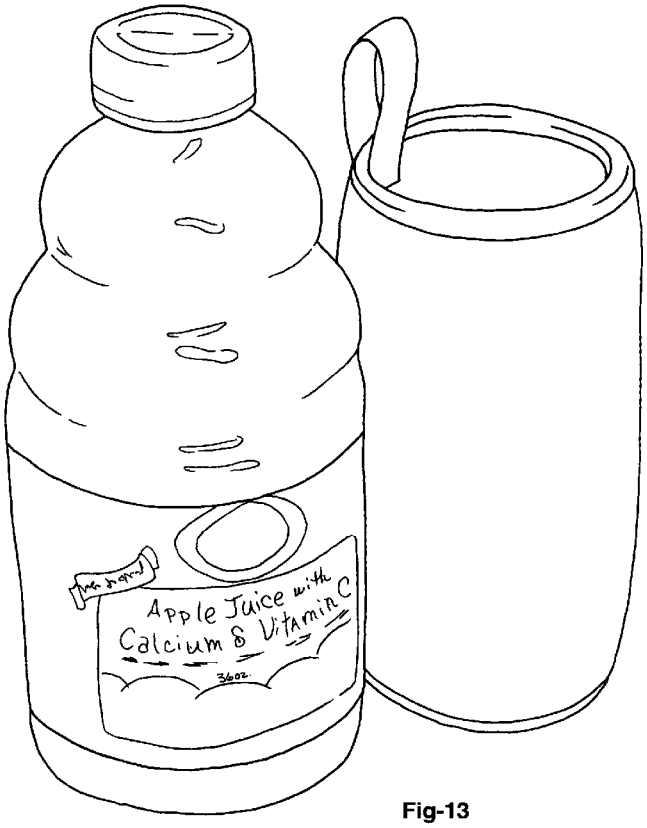
FIG. 13 is an isometric view of a large 46 oz. beverage container along side the insulator of FIG. 1.
Figure 14:
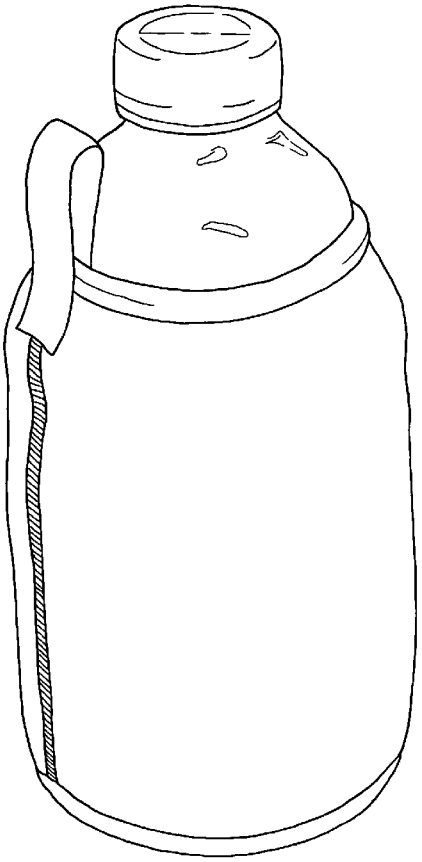
FIG. 14 is an isometric view of the 46 oz. beverage container of FIG. 13 covered by the insulator of FIG. 1.

Insulator 71 comprises two panels 73 (FIG. 6), each having two reversible surfaces 83, 85, and horizontal top and bottom edges 75, 77, measuring approximately 10.0 cm in width 80. Likewise, top and bottom edges 75, 77 have a vertical dimension 81 of approximately 10.0 cm. Each edge 15, 17 is provided with an elastic hem 79 having a vertical dimension of approximately 9 mm.

The curved side edges 91, 93 of panel 73 define a maximum width 95 in the horizontal direction of approximately 10.375 cm between their vertical midpoints. The narrow width of top and bottom edges 75, 77 skews side edges 91, 93 to make up the difference of 0.375 cm. Once again, the difference in these two horizontal dimensions is important for the proper implementation of insulator 71. Insulator 71 is formed by sewing two or more panels 73 together along side edges 91, 93 (FIG. 5). The smaller diameters of top and bottom edges 75, 77 and hems 79 give insulator 71 the ability to conform to both the vertical and horizontal dimensions of a beverage container.

In operation, one of the insulators are placed around a beverage container to better insulate the container and maintain the temperature of the beverage located therein. Each of the three embodiments of the present invention may be used to accommodate significant variation in the size and shape of beverage containers. For example, as shown in FIGS. 7 and 8, the smallest embodiment of insulator 71 is readily adaptable to conform to both a standard twelve fluid ounce can 97, such as those used for soft drinks or beer, and to a ten fluid ounce bottle 99, such as those used for juices. Even though can 97 is relatively shorter and wider than bottle 99, which is relatively taller and narrower (e.g., their respective vertical and horizontal dimensions differ significantly), the same insulator 71 conforms to both shapes while maintaining an attractive, streamlined appearance. In particular, the upper edge 75 of insulator 71 is able to expand to the large diameter at the upper end of can 97, as well as the very narrow neck at the upper end of bottle 99. An optional pull tab loop provided at the upper end of the insulators assists in the removal of the insulator from the container by pulling one from the other.

Each of the insulators of the present invention are also reversible. For example, the outer surfaces of the insulators shown in FIGS. 1, 3, 5, 7, and 8 are illustrated with a single solid color, while their inner surface may have a completely different color or illustration, as shown in FIG. 9. The insulators are simply turned inside out to display their inner surfaces on the exterior of a beverage container. Finally, as shown on the left side of FIG. 10, since each insulator is formed from two flat panels, they are readily collapsed into a flat state along the two vertical, opposed seams of their side edges.

The present invention has several advantages including the ability to prevent condensation on the exterior of a chilled beverage. The panel construction of the beverage thermal insulator described above allows it to laid flat for easy storage with minimal space requirements. In addition, multiple insulators may be stored within a single insulator for better bulk management. The insulator fits almost every handheld beverage dispenser or container for the size range it was designed to accommodate. The ability of the insulator to contour to the actual shape of the container also provides the user with a better grip. Design features of the insulator allow it to stretch vertically without compromising fit on the diameter or horizontal dimension of the container. The insulator is also easily mounted to and removed from containers. Unlike prior art designs, the streamlined but thermally efficient design of the present insulator does not prevent a covered container from being placed in conventionally-sized cup holder. In addition, the lower edge of the insulator may be rolled up, if necessary, to adjust a vertical dimension of the tube for a better fit on the container.

Symmetry of design allows the insulator to be reversible, giving the user two color and/or graphic design choices to display on the exterior of his or her container. Moreover, the construction of the insulator allows four panels (two sides to each of the two panels) for printing of licensed and/or business promotional art, instead of the one or two panels available with prior art designs. Finally, the ability of insulators constructed in accordance with the present invention to fit on so many types and sizes of containers, convenience of use and storage, and attractive appearance, appeals to a broader range of beverage consumers.

While the invention has been shown or described in only some of its forms, it should be apparent to those skilled in the art that it is not so limited, but is susceptible to various changes without departing from the scope of the invention.

What is claimed is:

1. A highly adaptable thermal insulator for various size and shape ranges of beverage containers, comprising:

a plurality of elastic panels joined together to form a cylindrical tube having an axis and open and unobstructed upper and lower ends defined by top and bottom edges of the panels, respectively, such that the tube is void of a bottom support for a beverage container, the tube being adapted to allow the beverage container to pass and extend through the upper end and the lower end; and both the upper and lower ends of the tube and the tube itself being adapted to accommodate, conform, and contour to beverage containers having a broad range of sizes and shapes; and wherein the top and bottom edges of the panels are substantially straight, and each of the panels also has two side edges that are curved.

2. The insulator of claim 1 wherein the tube is formed from two of the elastic panels, each of which consists of a single sheet of neoprene.

3. The insulator of claim 1, wherein the panels are joined together along their curved side edges to form the tube, the tube having upper and lower diameters at the upper and lower ends, respectively, and a middle diameter located between the upper and lower ends that is greater than the upper and lower diameters.

4. A highly adaptable thermal insulator for various size and shape ranges of beverage containers, comprising:

a plurality of elastic panels joined together to form a cylindrical tube having an axis and open and unobstructed upper and lower ends defined by top and bottom edges of the panels, respectively, such that the tube is void of a bottom support for a beverage container, the tube being adapted to allow the beverage container to pass and extend through the upper end and the lower end;

both the upper and lower ends of the tube and the tube itself being adapted to accommodate, conform, and contour to beverage containers having a broad range of sizes and shapes; and an elastic band on each of the upper and lower ends, the elastic bands extending continuously around respective ones of the top and bottom edges of all of the plurality of elastic panels to slightly reduce an elasticity of the tube at the upper and lower ends with respect to an elasticity of a remainder of the tube.

5. The insulator of claim 4 wherein each of the elastic bands has a single seam that aligns and coincides with a junction between two of the plurality of elastic panels.

6. The insulator of claim 1 wherein the tube has interior and exterior surfaces with different graphic designs, and the tube can be turned inside out such that the tube is completely reversible between two configurations to display either one of the different graphic designs.

7. The insulator of claim 6, further comprising a pull tab loop secured adjacent to and extending from the upper end for assisting in removal of the insulator from the beverage container, the pull tab loop being secured to the tube such that an appearance of the pull tab loop relative to the tube is the same in both configurations, thereby making the pull tab loop reversible as well.

8. The insulator of claim 6 wherein, in addition to being completely reversible between the two configurations, the upper and lower ends may be partially rolled over on the tube as well to adjust a vertical dimension of the tube along the axis.

9. A highly adaptable thermal insulator for various size and shape ranges of beverage containers, comprising:

a plurality of elastic panels, each having substantially straight top and bottom edges, and curved side edges extending therebetween, the top and bottom edges having a width that is less than a width extending between the curved side edges, the panels being joined together along their curved side edges to form a cylindrical tube having an axis, and open upper and lower ends defined by the top and bottom edges, respectively, the tube also having upper and lower diameters at the upper and lower ends, respectively, and a diameter located axially between the upper and lower ends and coinciding with the width extending between the curved side edges that is greater than the upper and lower diameters; and wherein the tube being adapted to accommodate, conform, and contour to beverage containers having a broad range of sizes and shapes.

10. The insulator of claim 9 wherein the tube is formed from two of the elastic panels, each of which consists of a single sheet of neoprene.

11. The insulator of claim 9, further comprising an elastic band on each of the upper and lower ends, the elastic bands extending continuously around the top and bottom edges of the elastic panels to slightly reduce an elasticity of the tube at the upper and lower ends with respect to an elasticity of a remainder of the tube, and each of the elastic bands having a single seam that aligns and coincides with a junction between the curved side edges of two of the elastic panels.

12. The insulator of claim 9 wherein the tube has interior and exterior surfaces with different graphic designs, and the tube can be turned inside out such that the tube is completely reversible between two configurations to display either one of the different graphic designs.

13. A highly adaptable thermal insulator for various size and shape ranges of beverage containers, comprising:

a pair of elastic panels, each having straight top and bottom edges, two convex side edges, and two planar surfaces, each of the surfaces having a different graphic design, the panels being joined together along their convex side edges to form a cylindrical tube having an axis extending in a vertical direction, two opposed vertical seams, and open circular upper and lower ends defined by the top and bottom edges, respectively; and the tube accommodates and contours to various size and shape ranges of beverage containers, the tube can be turned inside out such that the tube is completely reversible between two configurations to display either one of the different graphic designs, and the upper and lower ends can be rolled over on the tube to adjust a vertical dimension of the tube.

14. The insulator of claim 13 wherein the tube can accommodate, contour, and conform to both a ten ounce juice bottle and a twelve ounce soda can.

15. The insulator of claim 13 wherein the tube can accommodate, contour, and conform to both a quart-sized bottle and 1.5 liter bottle.

16. The insulator of claim 13 wherein the tube has upper and lower diameters at the upper and lower ends, respectively, and a middle diameter located between the upper and lower ends that is greater than the upper and lower diameters.

17. The insulator of claim 13, further comprising an elastic band on each of the upper and lower ends, the elastic bands extending continuously around respective ones of the top and bottom edges of the elastic panels to slightly reduce an elasticity of the tube at the upper and lower ends with respect to an elasticity of a remainder of the tube.

18. The insulator of claim 17 wherein each of the elastic bands has a single seam that aligns and coincides with a junction between the elastic panels.

19. The insulator of claim 13, further comprising a pull tab loop secured adjacent to and extending from the upper end for assisting in removal of the insulator from the beverage container, the pull tab loop being secured to the tube such that an appearance of the pull tab loop relative to the tube is the same in both configurations, thereby making the pull tab loop reversible as well.

* * * * *